US006218798B1

(12) United States Patent
Price et al.

(10) Patent No.: US 6,218,798 B1
(45) Date of Patent: Apr. 17, 2001

(54) CENTRAL VACUUM INTERFACE FOR AIR EXCHANGER

(75) Inventors: Tamara Price; Douglas E. Johnson; Mitch Koestner, all of Webster City, IA (US); Vern Cunningham, Aurora (CA)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/439,784

(22) Filed: Nov. 12, 1999

(51) Int. Cl.[7] ..... A47L 5/00; F24F 7/007

(52) U.S. Cl. ..... 318/445; 318/446; 15/301; 454/238

(58) Field of Search ..... 318/41, 445, 446; 15/300.1, 301, 314; 454/228, 237, 238, 239, 370; 165/53

(56) References Cited

U.S. PATENT DOCUMENTS

| | | | |
|---|---|---|---|
| 2,431,726 | | 12/1947 | Bechtler . |
| 2,725,113 | | 11/1955 | Fagyas . |
| 2,979,755 | | 4/1961 | McCaskill . |
| 3,635,282 | | 1/1972 | Watanabe . |
| 3,849,866 | * | 11/1974 | Mol . |
| 3,951,336 | | 4/1976 | Miller et al. . |
| 4,497,362 | | 2/1985 | Teague, Jr. . |
| 4,991,253 | * | 2/1991 | Rechsteiner . |
| 5,173,646 | | 12/1992 | Reid . |
| 5,257,736 | | 11/1993 | Roy . |
| 5,902,182 | * | 5/1999 | Kramer ..... 454/255 |
| 5,924,163 | * | 7/1999 | Burns, Jr. ..... 15/314 |
| 6,131,571 | * | 10/2000 | Lampotang et al. ..... 128/204.21 |

* cited by examiner

*Primary Examiner*—Bentsu Ro
(74) *Attorney, Agent, or Firm*—Pearne & Gordon LLP

(57) ABSTRACT

A central vacuum cleaner system having a motor driven vacuum source which is selectively turned on or off. The central vacuum cleaner has an interface connector for establishing a connection between the central vacuum and an air exchanger. The interface connector is connected to be activated by the central vacuum when the motor is turned on so as to activate the air exchanger.

5 Claims, 3 Drawing Sheets

CENTRAL VACUUM INTERFACE FOR AIR EXCHANGER

BACKGROUND OF THE INVENTION

The present invention relates generally to vacuum powered cleaning systems for buildings. More specifically, the present invention relates to central vacuum systems having an interface to an air exchanger.

Modern residential and commercial buildings, especially single family homes, are built to resist external weather conditions. Construction techniques and materials are chosen to seal buildings so that air exchange between the interior and the exterior of the building is minimized to reduce heating and cooling costs. As a convenience, many buildings are also provided with a central vacuum system used to clean floors and other surfaces in the building. Briefly, a central vacuum system includes a motor driven vacuum unit, vacuum ports located throughout the structure, duct work placed in the walls of the building to connect the vacuum unit to the vacuum ports and a user manipulable cleaning attachment which mates with the vacuum ports. The vacuum source is typically placed in a somewhat remote location, such as a garage. Electrical cabling can be installed with the duct work to provide an electrical connection between the vacuum unit and the cleaning attachment. Such an electrical connection is used to switch the vacuum unit on or off. Other electrical connections can be used to power a rotary brush mounted on the cleaning attachment.

As the central vacuum system operates, air is exhausted from the building. This depletes the air inside the building, especially in buildings that are well sealed to prevent air transfer between the interior and exterior of the building. Various ways to introduce air into buildings are known in the art of building ventilation. As an example, U.S. Pat. No. 2,725,113, incorporated herein by reference, discloses a central vacuum system where both a fresh air supply opening and a vacuum source opening are provided on panels throughout the building. When the central vacuum is operating, a common motor supplies fresh air and suction to the panel being used by an operator. However, this example system does not balance the air flow of exhausted air and fresh air.

Air exchangers, otherwise referred to as air to air heat exchangers or heat recovery ventilators, for providing a balanced flow of air into and out of a building are also known. For example, U.S. Pat. No. 5,257,736, incorporated herein by reference, discloses an air exchanger having a pressure sensor. If the sensor detects a negative pressure in the building, the air exchanger stops pumping air out of the building to balance the air pressure. Air exchangers typically provide a range of functions such as reducing air contamination, heating or cooling air entering the building, and/or humidifying or dehumidifying air entering the building. Accordingly, the air exchanger is usually connected to the rest of the building's ventilation system and operates independently of other appliances. Therefore, there are no provisions for an electrical connection between the central vacuum system and the air exchanger for controlling an air exchanger. Operation of the vacuum is determined by sensing the resulting pressure differentiation rather than by an electrical connection.

SUMMARY OF THE INVENTION

The present invention overcomes these disadvantages by providing a central vacuum cleaner system having a motor driven vacuum source which is selectively turned on or off.

The central vacuum cleaner has an interface connector for establishing a connection between the central vacuum and an air exchanger. The interface connector is connected to be activated by the central vacuum when the motor is turned on so as to activate the air exchanger.

BRIEF DESCRIPTION OF THE DRAWING

These and further features of the present invention will be apparent with reference to the following description and drawings, wherein.

DETAILED DESCRIPTION OF THE INVENTION

Figure 1:
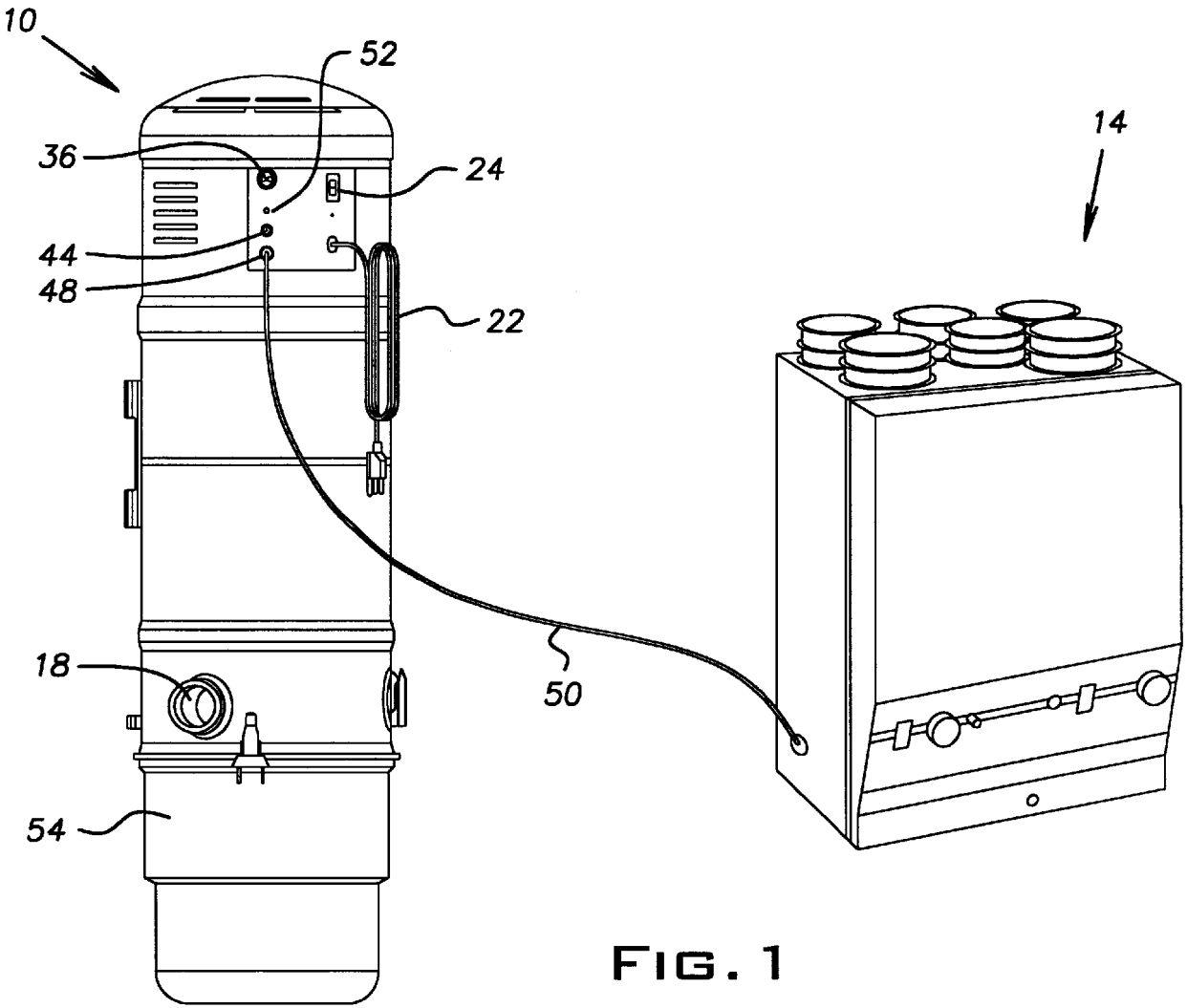
FIG. 1 is a schematic view of a central vacuum system according to the present invention.

In the detailed description which follows, identical components have been given the same reference numerals, regardless of whether they are shown in different embodiments of the present invention. In order to clearly and concisely illustrate the present invention, the drawings may not necessarily be to scale and certain features may be shown in somewhat schematic form.

Figure 2:
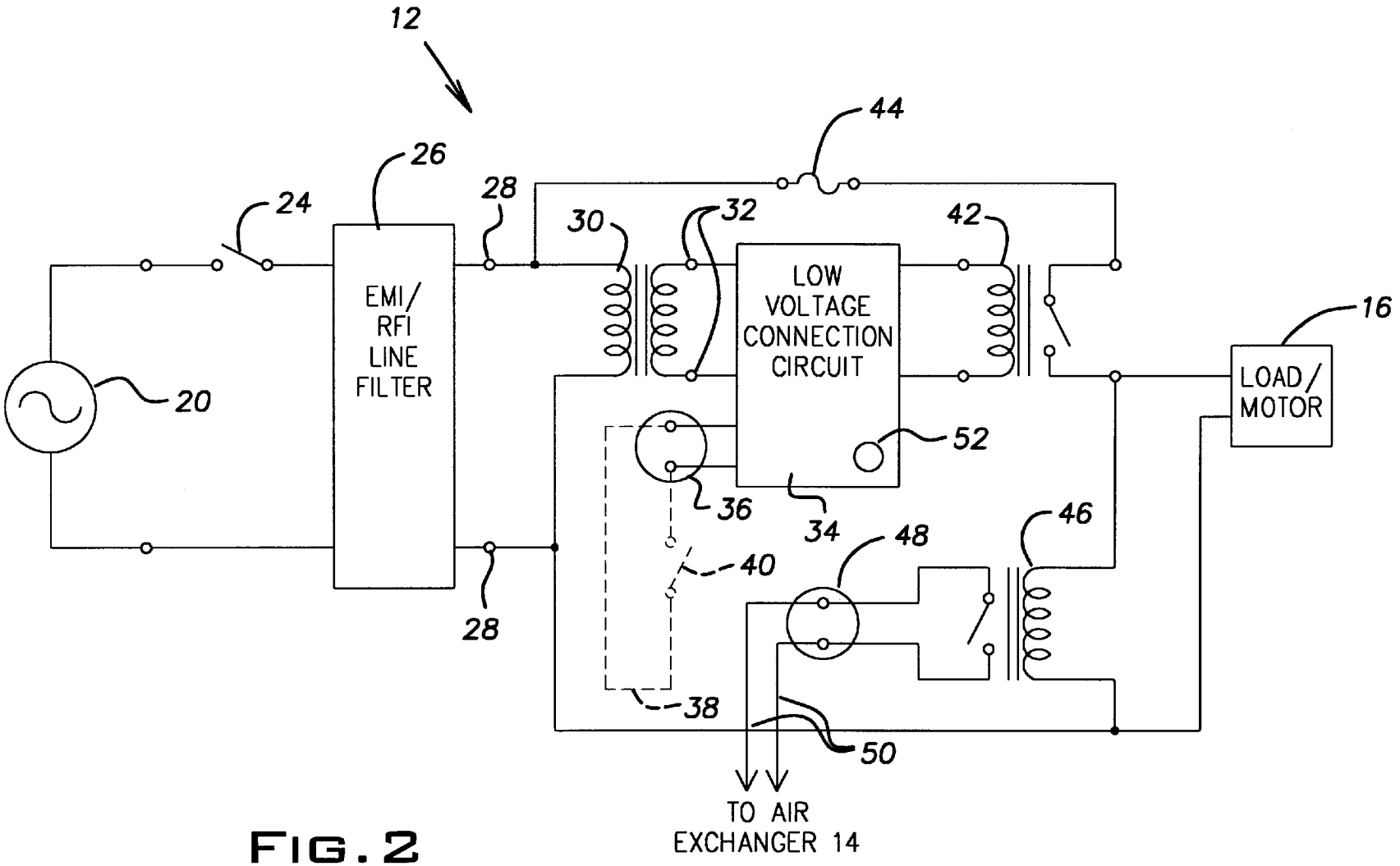
FIG. 2 is an electrical schematic of a central vacuum system having an interface to an air exchanger according to the present invention.

Referring to FIGS. 1 and 2, a central vacuum cleaner system 10 having an interface circuit 12 to an air exchanger 14 is illustrated. The air exchanger 14 is conventional and various models of air exchangers are sold by a variety of companies, including SunAIR of Muurame, Finland under the designation SunAIR 400 MX and Research Products corporation of Madison, Wisconsin under the designation PerfectAire Fresh Air Exchanger. The central vacuum 10 provides a motor 16 driven air suction source 18 used in the cleaning of residential and commercial buildings as described in the preceding sections. Conventional AC electrical power is supplied to the central vacuum 10 by a power source 20 through a grounded cord 22. Preferably, the power source 20 supplies 110–125 VAC or 220–240 VAC at 50 Hz or 60 Hz. The central vacuum 10 is provided with a main switch 24 for turning electrical power to the interface circuit 12 on or off. An optional EMI/RFI line filter 26 can be provided to reduce electrical transients present in the power supplied by the power source 20.

Outputs 28 of the filter 26 are connected to a primary winding of a step down transformer 30 for providing a low voltage source 32 to the interface circuit 12. Terminals of the low voltage source 32 are connected to a low voltage connection circuit 34. The low voltage connection circuit 34 is connected to a low voltage connector 36. The low voltage connector 36 is preferably a stand off terminal, or other type of standardized electrical connector, to physically and electrically connect to at least one conductor cable 38. The conductor cable 38 connects the low voltage connector 36 to a switch mechanism 40 located on a cleaning attachment or on a suction port to which the cleaning attachment connects. When the switch mechanism 40 is closed, conductivity is establish across the terminals of the low voltage connector 36 and the motor 16 is turned on by operation of the low voltage connection circuit 34. Preferably, the motor 16 is turned on by the low voltage connection circuit 34 by the triggering of a low voltage relay, or first relay 42. When the first relay 42 is triggered, a switch in the first relay 42 is closed providing power from the filter outputs 28 to the motor 16. Other means for turning on the motor are also suitable. For example, the power to the motor can be controlled by a manual switch separate from the low voltage connection circuit. Power to the motor 16 is supplied through an overload protection device 44, such as a fuse or circuit breaker.

A high voltage relay, or second relay 46, is connected in parallel with the motor 16. When the switch in the first relay 42 closes, the second relay 46 triggers a switch in the second relay 46 to also close. The switch in the second relay 46 is connected to an interface connector 48. The interface connector 48 is preferably a set of terminals, such as a stand off connector or the terminals of a standardized electrical connector, to physically and electrically connect to an interface cable 50. The interface cable 50 preferably has two conductors and connects the interface circuit 12 to the air exchanger 14. When the switch in the second relay 46 closes, conductivity is established between the terminals of the interface connector 48 and consequently conductivity is established between the conductors of the interface cable 50. A circuit located in the air exchanger 14 and connected to an air exchanger end of the interface cable 50 uses this conductivity as an indication to turn on the air exchanger 14. Essentially, the switch in the second relay 46 acts as an on/off switch for the air exchanger 14.

The effect of providing such an interface circuit 12 is to automatically turn on the air exchanger 14 when the motor 16 of the central vacuum 10 is turned on. The air exchanger will then introduce air into the building and balance the air drawn and exhausted from the building by the central vacuum 10. Since air is being drawn out of the building by the central vacuum 10, the air exchanger 14 will introduce more fresh air into the building than the air exchanger 14 exhausts itself. The interface circuit 12 also provides an isolated connection to the air exchanger 14 with no power exchange between the central vacuum 10 and the air exchanger 14. This type of connection is commonly referred to as a dry connection. As one skilled in the art will appreciate, other electrical components can be substituted for the second relay 46, such as opto-isolator. Alternatively, the second relay can be replaced with a low voltage relay connected in parallel with the first relay 42. Alternatively, the interface circuit 34 can generate a voltage or a current to signal the air exchanger 14 to turn on. Other signals, such as messages sent over a telecommunications interface, can be used between the central vacuum 10 and the air exchanger 14 with similar results.

Figure 3:
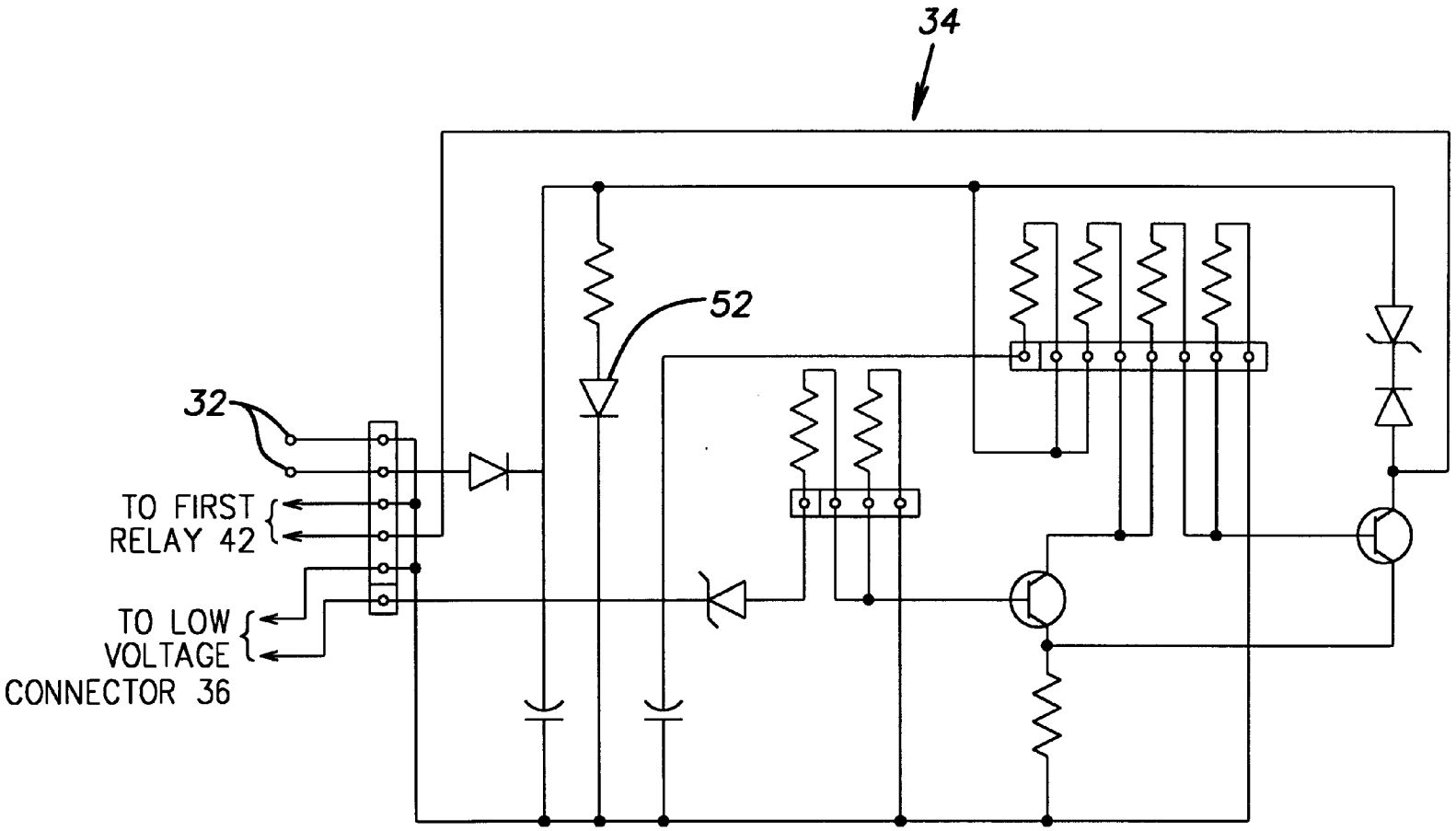
FIG. 3 is an example electrical schematic of a low voltage connection circuit for use with the central vacuum system having an interface to an air exchanger.

FIG. 3 shows an example low voltage connection circuit 34. The low voltage connection circuit 34 is provided with power from the secondary winding of transformer 30 through the low voltage source 32. The low voltage connection circuit is provided with circuitry to trigger the first relay 42 when a switch mechanism 40 is closed to establish conductivity across the terminals of the low voltage connector 36. As one skilled in the art will appreciate, a variety of DC and AC circuits can be used to implement this functionality. The low voltage connection circuit is preferably provided with an LED 52 or other indicator for indicating an operational condition of the central vacuum 10. The low voltage connection circuit 34 can be provided with a full or half wave rectifier for providing DC voltage as necessary to power the relays and any solid state components. The low voltage connection circuit 34 can optionally be provided with a microprocessor for enhanced operational control of the central vacuum 10. For example, the microprocessor can keep track of motor 16 run time and shut off the motor 16 after a predetermined period of time indicating to the user that it may be time to empty a debris collection chamber 54.

Although particular embodiments of the invention have been described in detail, it is understood that the invention is not limited correspondingly in scope, but includes all changes and modifications coming within the spirit and terms of the claims appended hereto.

What is claimed is:

1. A central vacuum cleaner system comprising, a motor driven vacuum source, the motor being selectively turned on or off, and an interface connector for establishing a connection between the central vacuum and an air exchanger, wherein the interface connector is connected to be activated by the central vacuum when the motor is turned on so as to activate the air exchanger.

2. The system according to claim 1, wherein the interface connector provides electrical isolation between the central vacuum and the air exchanger.

3. The system according to claim 1, wherein the interface connector is a set of terminals, the interface connector being activated by an establishment of electrical connectivity between the terminals.

4. The system according to claim 3, wherein the interface connector terminals are connected to a relay, the relay connected to trigger electrical connectivity between the terminals.

5. The system according to claim 4, wherein the relay is connected in parallel with the motor.

* * * * *